US010085603B2

(12) United States Patent
Kim et al.

(10) Patent No.: US 10,085,603 B2
(45) Date of Patent: Oct. 2, 2018

(54) VACUUM CLEANER

(71) Applicant: SAMSUNG ELECTRONICS CO., LTD., Suwon-si (KR)

(72) Inventors: Tak Soo Kim, Suwon-si (KR); Joo Seok Jeong, Suwon-si (KR); Oh Kyu Kwon, Suwon-si (KR); Dong Houn Yang, Suwon-si (KR); Dong Hun Yoo, Suwon-si (KR); Sang-Woo Lee, Suwon-si (KR); Yun Won Jung, Suwon-si (KR)

(73) Assignee: SAMSUNG ELECTRONIC CO., LTD., Suwon-si (KR)

( * ) Notice: Subject to any disclaimer, the term of this patent is extended or adjusted under 35 U.S.C. 154(b) by 286 days.

(21) Appl. No.: 14/842,231

(22) Filed: Sep. 1, 2015

(65) Prior Publication Data

US 2016/0081521 A1 Mar. 24, 2016

Related U.S. Application Data

(60) Provisional application No. 62/045,234, filed on Sep. 3, 2014.

(30) Foreign Application Priority Data

Jan. 5, 2015 (KR) ..... 10-2015-0000875

(51) Int. Cl.
*B08B 5/04* (2006.01)
*A47L 5/22* (2006.01)
(Continued)

(52) U.S. Cl.
CPC ..... *A47L 5/225* (2013.01); *A47L 5/28* (2013.01); *A47L 5/32* (2013.01); *A47L 9/242* (2013.01); *A47L 9/248* (2013.01); *A47L 9/32* (2013.01)

(58) Field of Classification Search
None
See application file for complete search history.

(56) References Cited

U.S. PATENT DOCUMENTS

2011/0219568 A1 9/2011 Conrad
2011/0219569 A1* 9/2011 Vines ..... A47L 5/28 15/340.2
(Continued)

FOREIGN PATENT DOCUMENTS

JP 2009-82266 4/2009
KR 10-2003-0034436 5/2003

*Primary Examiner* — Binh X Tran
*Assistant Examiner* — David Cathey, Jr.
(74) *Attorney, Agent, or Firm* — Stass & Halsey LLP

(57) ABSTRACT

Disclosed herein is a vacuum cleaner including a first cleaning module to perform a cleaning of a floor and a second cleaning module detachably coupled to the first cleaning module and configured to perform a cleaning in a handheld manner while detached from the first cleaning module, wherein the second cleaning module includes a connecting pipe to deliver inlet force to an inlet of the first cleaning module while connected to the first cleaning module, a handle connected to one side of the connecting pipe, having an inside space, and provided in a shape in which a rear surface thereof is open, a connecting hose connecting the connecting pipe to a dust collector, and a connector having a hose support provided to support the connecting hose, and to connect the connecting pipe to the connecting hose, and the hose support is disposed to support the connecting hose rounded along an inner side of the handle in a state that the connector is coupled to an inside space of the handle.

10 Claims, 11 Drawing Sheets

(51) Int. Cl.

| | |
|---|---|
| ***A47L 5/32*** | (2006.01) |
| ***A47L 9/24*** | (2006.01) |
| ***A47L 9/32*** | (2006.01) |
| ***A47L 5/28*** | (2006.01) |

(56) References Cited

U.S. PATENT DOCUMENTS

| | | | | |
|---|---|---|---|---|
| 2011/0219581 | A1* | 9/2011 | Vines | A47L 5/28 15/410 |
| 2011/0225764 | A1 | 9/2011 | Muhlenkamp et al. | |
| 2012/0030899 | A1 | 2/2012 | Lindsey et al. | |
| 2013/0269147 | A1* | 10/2013 | Conrad | A47L 5/225 15/329 |
| 2014/0283332 | A1* | 9/2014 | Conrad | A47L 5/225 15/389 |

* cited by examiner

VACUUM CLEANER

CROSS-REFERENCE TO RELATED APPLICATIONS

This application claims the benefit of U.S. patent application Ser. No. 62/045,234, filed on Sep. 3, 2014 in the U.S. Patent and Trademark Office, and Korean Patent Application No. 2015-0000875, filed on Jan. 5, 2015, in the Korean Intellectual Property Office, the disclosures of both of which are incorporated herein by reference.

BACKGROUND

1. Field

Embodiments of the present disclosure relate to a vacuum cleaner provided to be used in an upright manner and a handheld manner.

2. Description of the Related Art

In general, a vacuum cleaner is an apparatus configured to draw air over a surface to be cleaned as the air includes a foreign substance, collect the foreign substance after separating the foreign substance from the air, and expel the purified air to an outside a body.

The vacuum cleaner as such, by the shape thereof, is distinguished into a canister type provided with a body and an inlet nozzle connected to each other by a predetermined pipe while the body and the inlet nozzle are separated, and an upright type having an inlet nozzle and a body integrally provided.

From the vacuum cleaner as such, a vacuum cleaner configured to use both the upright manner and the handheld manner while provided with a first cleaning module to clean a floor by using the upright manner and a second cleaning module used in the handheld manner while detachably installed at the first cleaning module may be present.

SUMMARY

Therefore, it is an aspect of the present disclosure to provide a vacuum cleaner having an improved structure such that a connecting hose is closely disposed to the vacuum cleaner while in a state that the vacuum cleaner is coupled.

It is another aspect of the present disclosure to provide a vacuum cleaner having an improved structure so as to decrease the weight of the vacuum cleaner provided to be used in an upright manner and in a handheld manner.

Additional aspects of the disclosure will be set forth in part in the description which follows and, in part, will be obvious from the description, or may be learned by practice of the disclosure.

In accordance with one aspect of the present disclosure, a vacuum cleaner includes a first cleaning module to perform a cleaning of a floor, and a second cleaning module detachably coupled to the first cleaning module to perform a cleaning in a handheld manner while detached from the first cleaning module, and the second cleaning module includes a connecting pipe to deliver inlet force to an inlet of the first cleaning module while connected to the first cleaning module, a handle connected to one side of the connecting pipe, having an inside space, and provided in a shape in which a rear surface thereof is open, a connecting hose connecting the connecting pipe to a dust collector; and a connector having a hose support provided to support the connecting hose, and to connect the connecting pipe to the connecting hose, and the hose support is disposed to support the connecting hose rounded along an inner side of the handle in a state that the connector is coupled to an inside space of the handle.

The hose support is provided such that the shape of an upper surface thereof is rounded, and the upper surface of the hose support is provided to support a lower surface of the rounded connecting hose in a state that the connector is coupled to an inside space of the handle.

The connector further includes a connector body, and a first coupler formed at one side of the connector body so that the connecting hose is coupled thereto, and the first coupler may be provided while bent toward an inner side of the handle in a state that the connector is coupled to an inside space of the handle.

The hose support may be disposed at a rear of the first coupler in a state that the connector is coupled to an inside space of the handle.

The hose support may be provided with a side surface thereof formed to be parallel with respect to the connector body.

The connector may be provided to be detached from the handle.

In accordance with another aspect of the present disclosure, a vacuum cleaner includes a first cleaning module to perform a cleaning of a floor, and a second cleaning module detachably coupled to the first cleaning module to perform a cleaning in a handheld manner while detached from the first cleaning module, and the second cleaning module includes a connecting pipe to deliver inlet force to an inlet of the first cleaning module while connected to the first cleaning module, a handle connected to one side of the connecting pipe, having an inside space, and provided in a shape in which a rear surface thereof is open, a connecting hose connecting the connecting pipe to the dust collector, and a connector to connect the connecting pipe to the connecting hose, and the connector includes a hose support provided such that the connecting hose is rounded along an inner side of the handle in a state that the connecting hose is coupled to an inside space of the handle, and to guide the connecting hose to be extended toward a lower direction in a parallel state with respect to the connecting pipe.

The hose support is provided such that the shape of an upper surface thereof is rounded, and the upper surface of the hose support is provided to support a lower surface of the rounded connecting hose in a state that the connector is coupled to an inside space of the handle.

The connector further includes a connector body, and a first coupler formed at one side of the connector body so that the connecting hose is coupled thereto, and the first coupler may be provided while bent toward an inner side of the handle in a state that the connector is coupled to an inside space of the handle.

The hose support may be disposed at a rear of the first coupler in a state that the connector is coupled to an inside space of the handle.

In accordance with one embodiment of the present disclosure, an exterior appearance of a vacuum cleaner may be provided in a slim shape.

In detail, the exterior appearance of the vacuum cleaner may be formed in a slim shape by having a connector provided with a hose support guide a connecting hose to be closely attached to the vacuum cleaner at an inside a handle.

Parts are saved as the connecting pipe is provided to perform a role of a body of the vacuum cleaner in a state that the vacuum cleaner is coupled, and thus the weight of the vacuum cleaner may be decreased.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
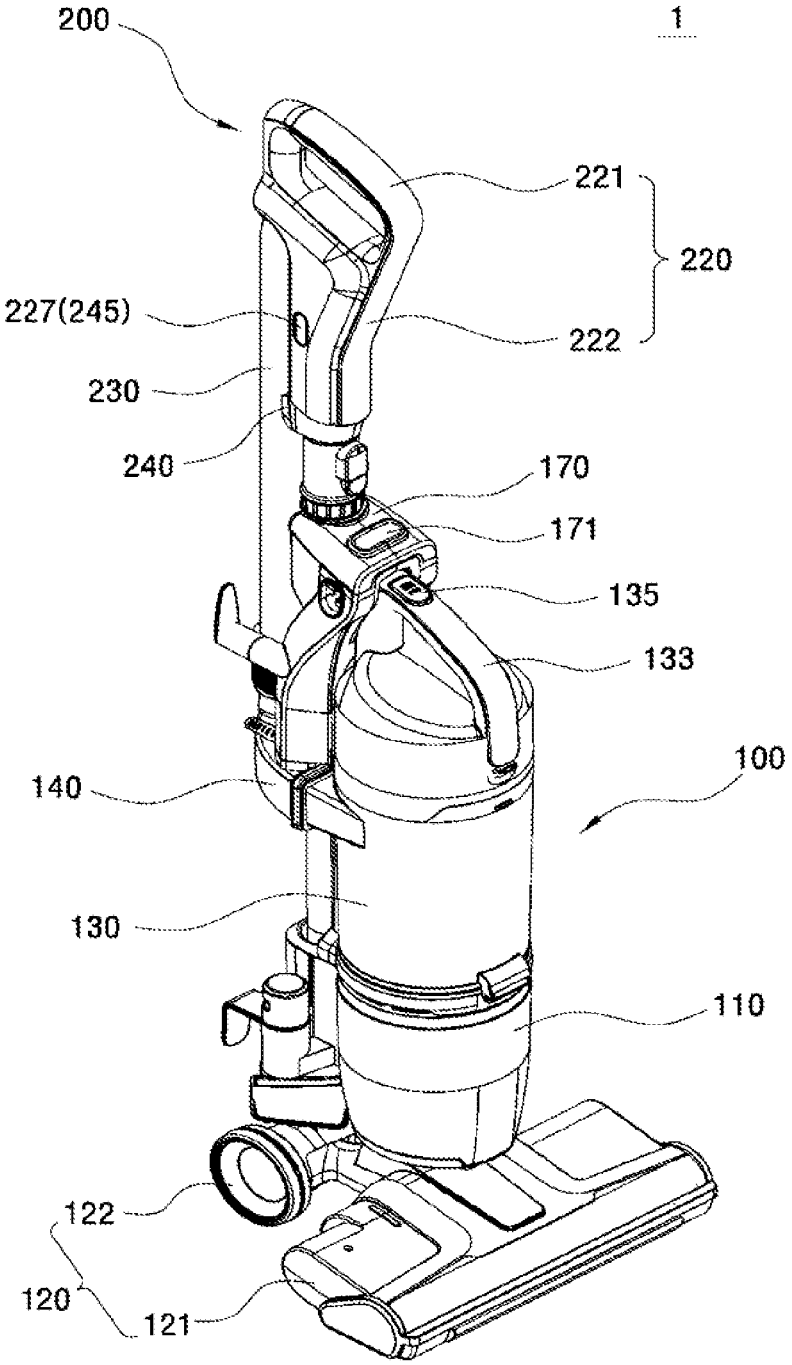
FIG. 1 is a perspective view of a vacuum cleaner seen from a front in accordance with one embodiment of the present disclosure.

Reference will now be made in detail to the embodiments of the present disclosure, examples of which are illustrated in the accompanying drawings, wherein like reference numerals refer to like elements throughout.

Figure 2:
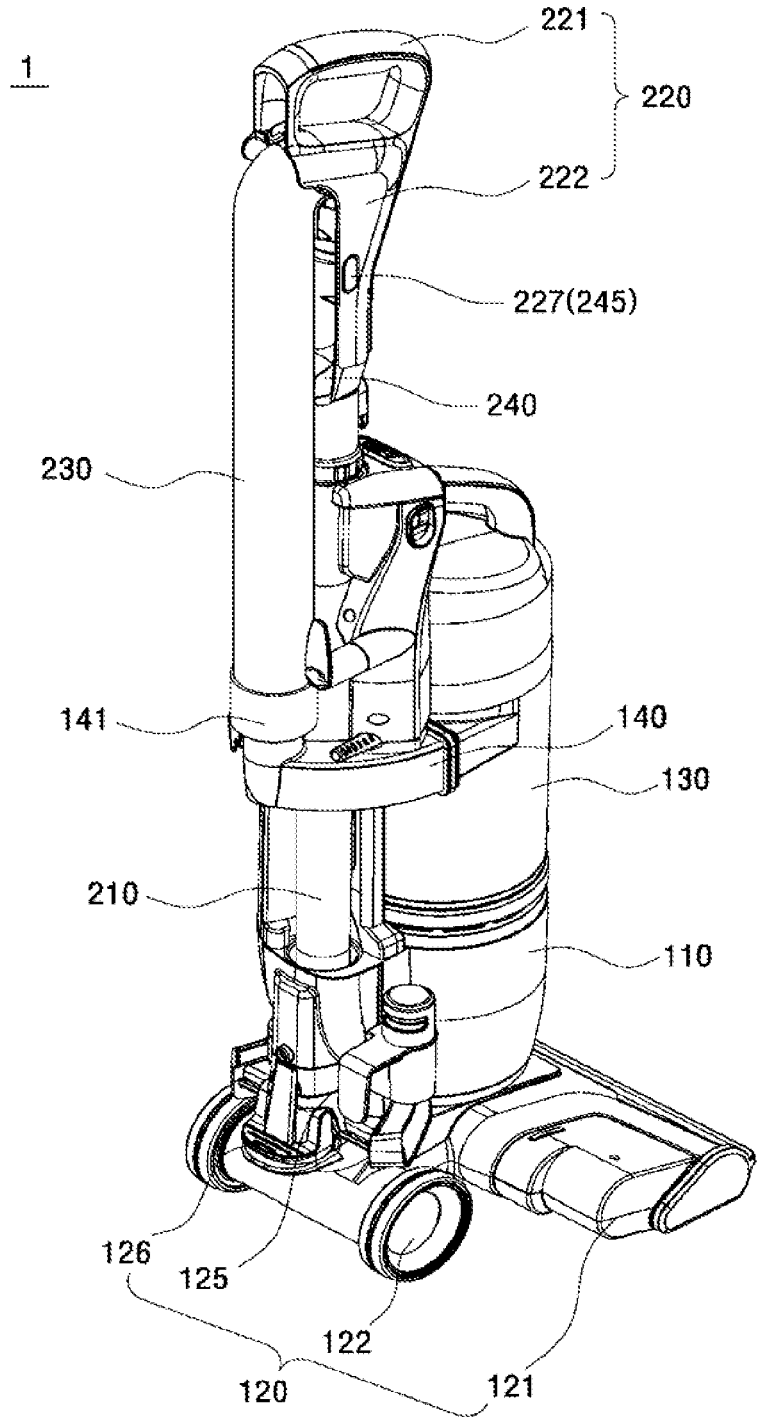
FIG. 2 is a perspective view showing a right side of a rear surface of the vacuum cleaner in accordance with one embodiment of the present disclosure.
Figure 3:
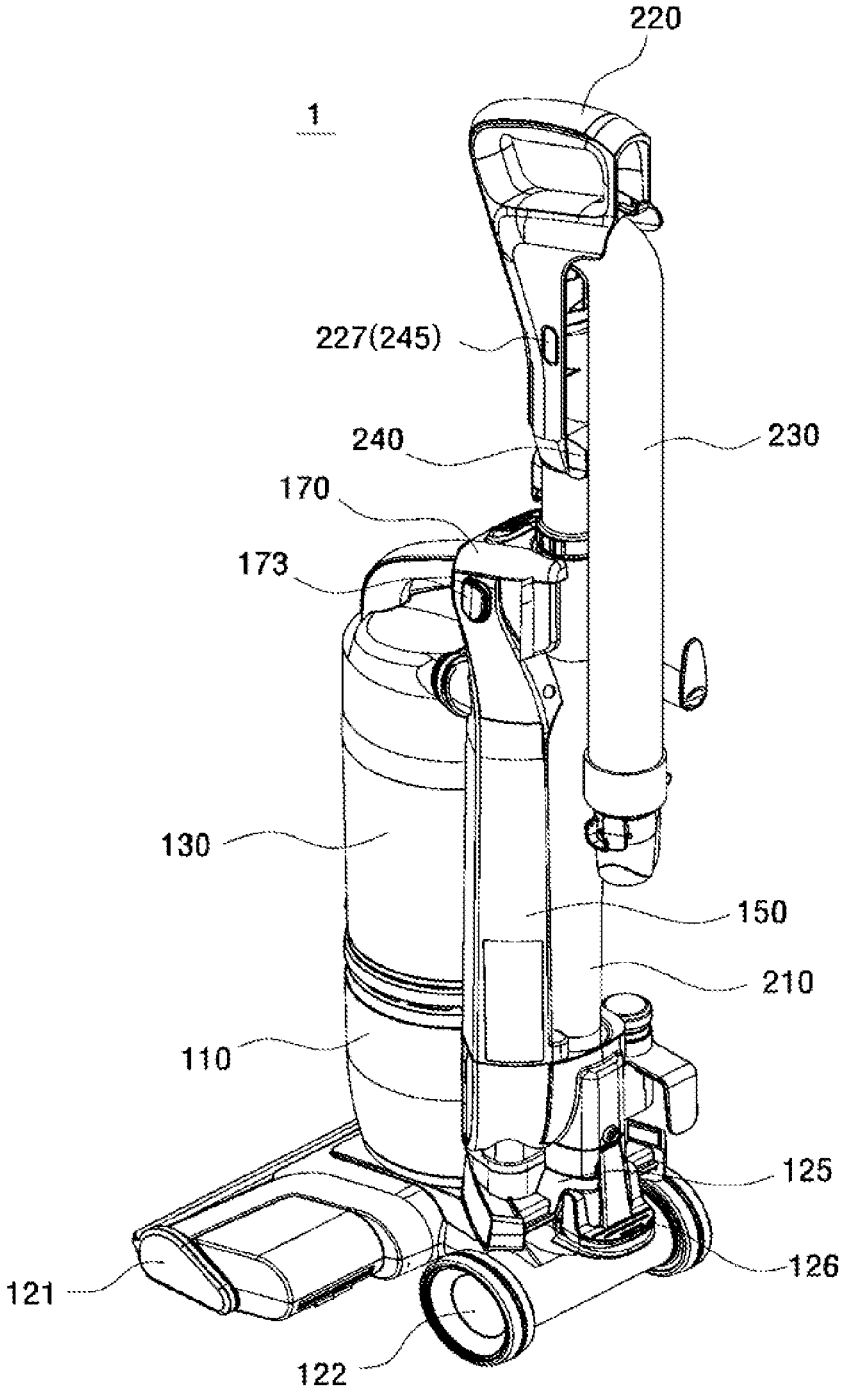
FIG. 3 is a perspective view showing a left side of a rear surface of the vacuum cleaner in accordance with one embodiment of the present disclosure.
Figure 4:
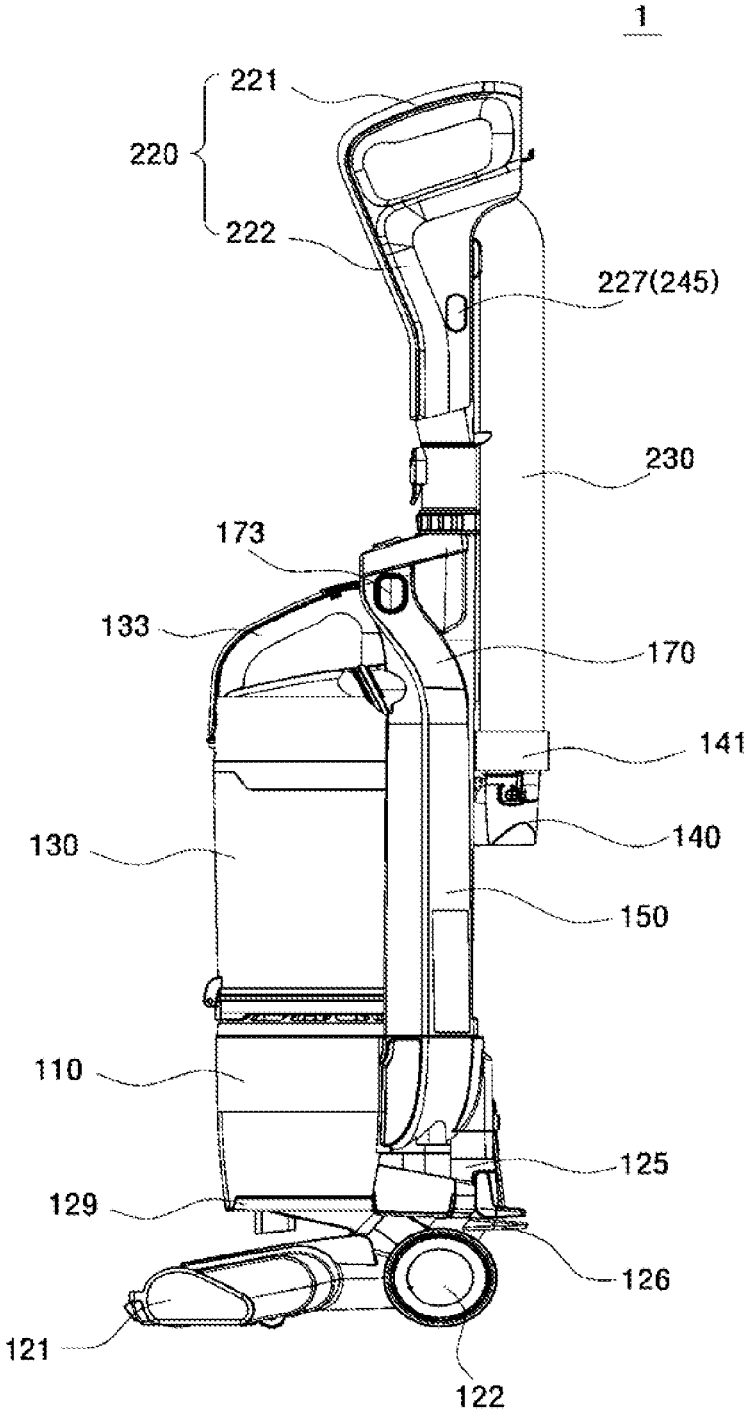
FIG. 4 is a drawing showing a left side surface of the vacuum cleaner in accordance with one embodiment of the present disclosure.
Figure 5:
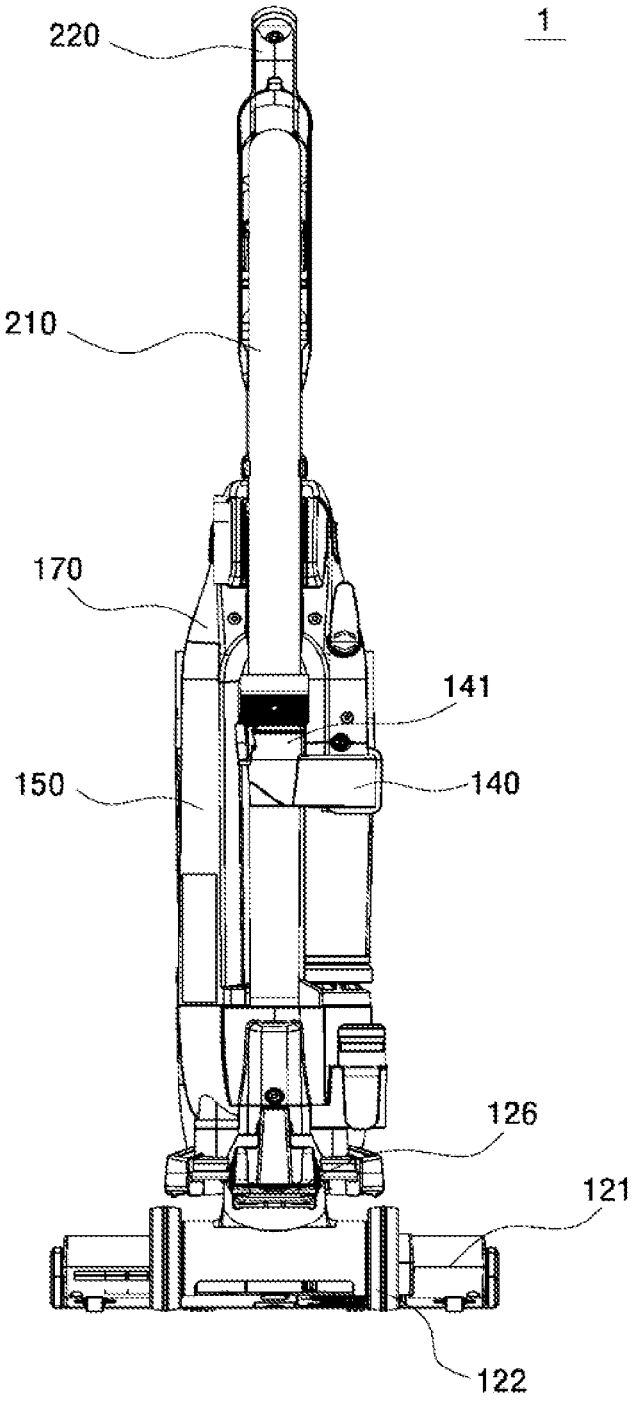
FIG. 5 is a drawing showing a rear surface of the vacuum cleaner in accordance with one embodiment of the present disclosure.
Figure 6:
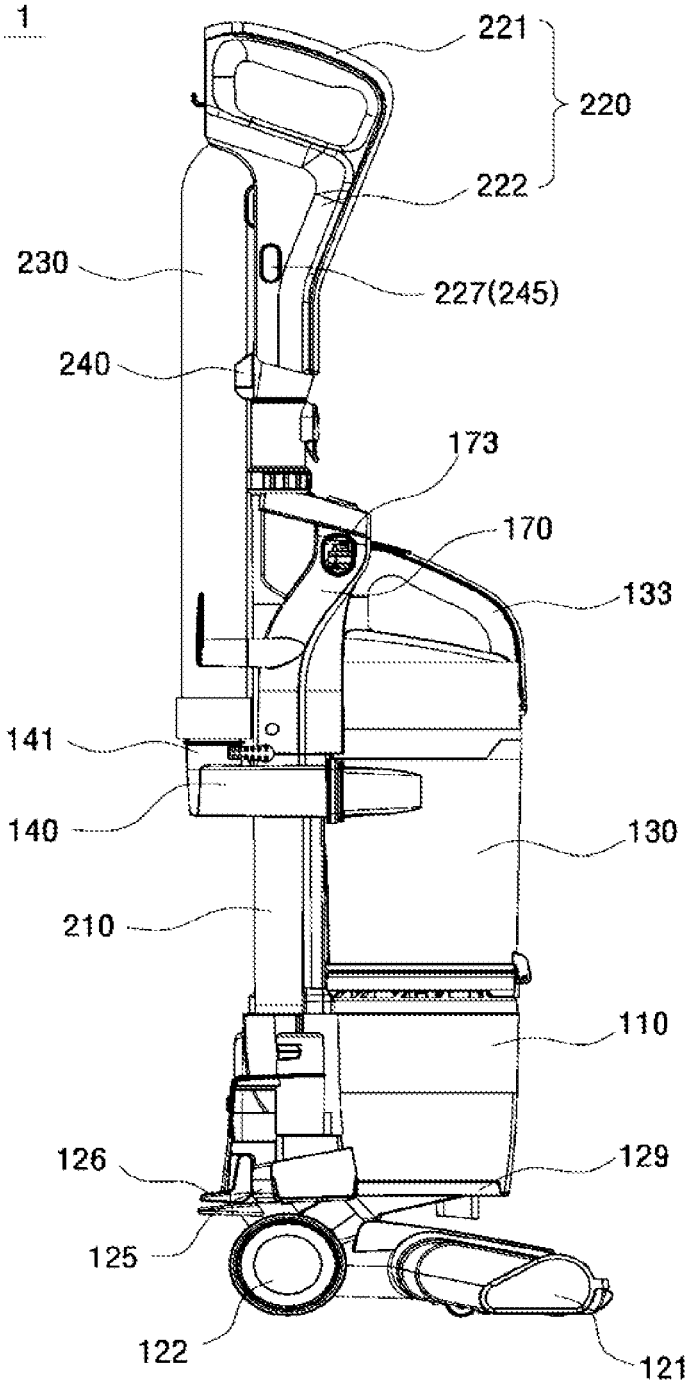
FIG. 6 is a drawing showing a right side surface of the vacuum cleaner in accordance with one embodiment of the present disclosure.
Figure 7:
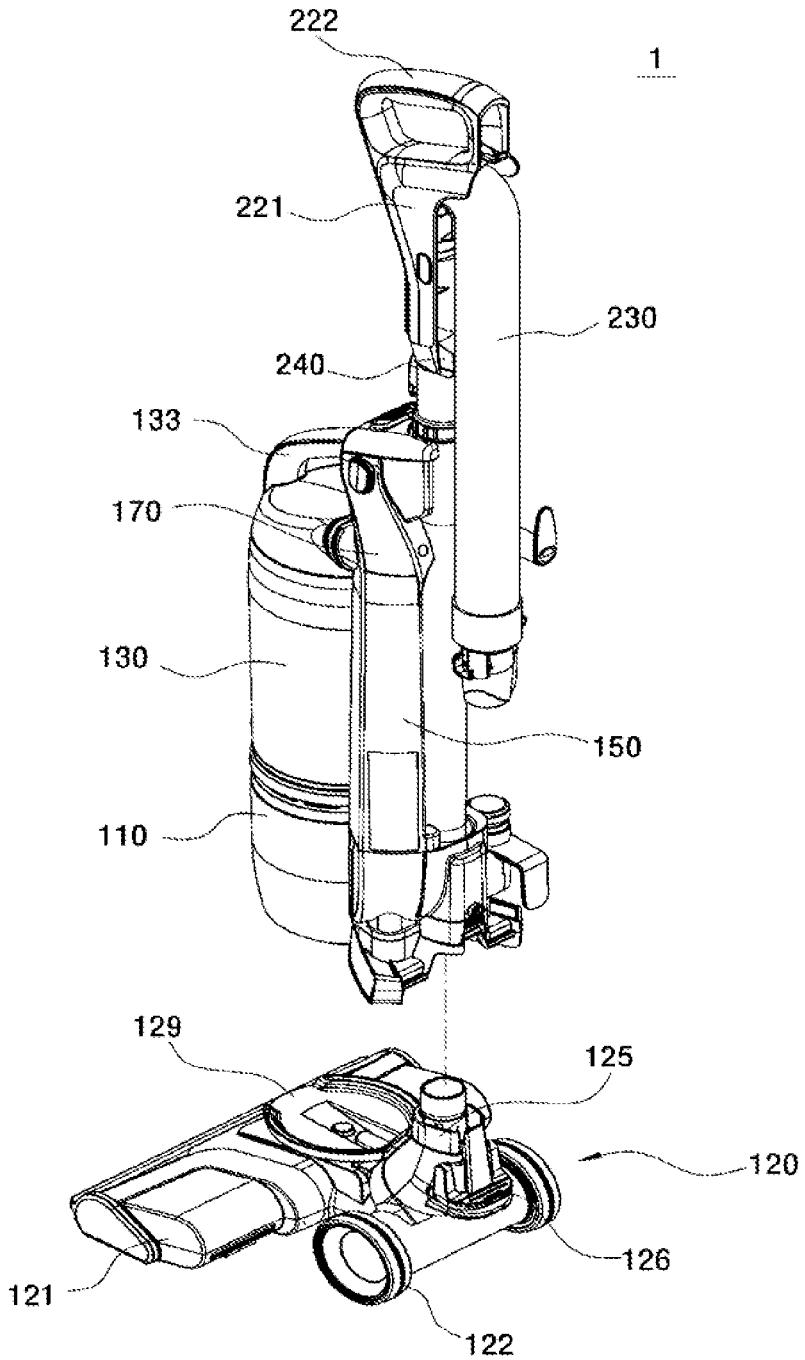
FIG. 7 is a perspective view showing a state of a head disassembled from the vacuum cleaner in accordance with one embodiment of the present disclosure.

FIG. 1 is a perspective view of a vacuum cleaner seen from a front in accordance with one embodiment of the present disclosure, FIG. 2 is a perspective view showing a right side of a rear surface of the vacuum cleaner in accordance with one embodiment of the present disclosure, FIG. 3 is a perspective view showing a left side of a rear surface of the vacuum cleaner in accordance with one embodiment of the present disclosure, FIG. 4 is a drawing showing a left side surface of the vacuum cleaner in accordance with one embodiment of the present disclosure, FIG. 5 is a drawing showing a rear surface of the vacuum cleaner in accordance with one embodiment of the present disclosure, FIG. 6 is a drawing showing a right side surface of the vacuum cleaner in accordance with one embodiment of the present disclosure, and FIG. 7 is a perspective view showing a state of a head disassembled from the vacuum cleaner in accordance with one embodiment of the present disclosure.

Referring to FIG. 1 to FIG. 7, a vacuum cleaner in accordance with one embodiment of the present disclosure may include a first cleaning module 100 configured to clean a floor in an upright manner, and a second cleaning module 200 detachably installed at the first cleaning module and configured to perform a cleaning in a handheld manner while separated from the first cleaning module 100.

The first cleaning module 100 may include a body 110, a head 120 and a dust collector 130.

The body 110 may be disposed at an upper portion of the head 120. The body 110 may be provided with a fan motor (not shown) configured to generate inlet force disposed at an inside thereof.

As illustrated on FIG. 7, the head 120 may be provided to be moved while making contact with a floor surface so that dust is inducted. The head 120 may include an inlet 121 and a wheel assembly 122.

The inlet 121 may be provided at one side of a lower portion of the first cleaning module 100. The inlet 121 may be provided as to induct the dust that is present on a floor surface.

The inlet 121 may be provided with an inlet hole (not shown) at a lower surface thereof. The inlet hole may be provided in the form of a space to which dust is inducted along with air while delivered with the inlet force generated at the fan motor. The inlet 121 may further include a brush (not shown) rotatively installed at the inlet hole. The brush, by lifting the dust closely attached at a floor surface while the brush is rotated, may be provided to have the dust easily inducted to an inside the vacuum cleaner 1 through the inlet hole.

The wheel assembly 122 may be installed at a rear of the inlet 121. The wheel assembly 122 may be provided such that the vacuum cleaner 1 is moved along a floor surface.

The wheel assembly 122 may include a pair of wheels 122*a* disposed at both left and right sides, and a wheel body 142 at which the two wheels 122*a* are rotatively installed and connected to the inlet 121.

The head 120 may include a pipe connector 125, a separation lever 126, and a body support 129.

The pipe connector 125 may be provided to be connected to a connecting pipe 210 of the second cleaning module 200, which is to be described later. The pipe connector 125, while connected to the connecting pipe 210, may be provided such that the dust inducted at the inlet 121 is moved to the connecting pipe 210. The pipe connector 125 may be detachably coupled to the connecting pipe 210.

The separation lever 126 may be installed at one side of the pipe connector 125. The separation lever 126 may separate the pipe connector 125 and the connecting pipe 210. A user, by pressing the separation lever 126, may separate the pipe connector 125 and the connecting pipe 210 in a coupled state. The separation lever 126 may be installed at a rear of the pipe connector 125 so that a user may easily manipulate the separation lever 126.

The body support 129 is installed at an upper portion of the head 120, and the body 110 may be settled. The body support 129 may fix the position of the body 110 in a state that the first cleaning module 100 and the second cleaning module 200.

The dust collector 130 may be disposed at an upper portion of the body 110. The dust collector 130 may collect dust by separating the dust from air after delivered with the air that is inducted at the head 120. The dust collector 130 in the present embodiment may collect dust by separating the dust from air in a cyclone manner. The dust collector 130 may be provided to be detached from the first cleaning module 100.

The dust collector 130 may be provided with a grip 133 at an upper portion thereof. A separation switch 135 may be installed at one side of an upper surface of the grip 133. The dust collector 130 may be separated from the first cleaning module 100 as the separation switch 135 is pressed. The grip 133 may be provided to easily grip the separated dust collector 130.

The first cleaning module 100 may further include a first duct 140, a second duct 150, and a fixing frame 170.

The first duct 140 may connect the dust collector 130 to a connecting hose 230, which is to be described later. The first duct 140 may perform a role as a path to deliver the air, which includes the dust moved though the connecting hose 230, to the dust collector 130. In addition, the first duct 140 may perform a role as a path through which the inlet force, which is generated at the fan motor and moved at the dust collector 130, is moved to the connecting hose 230.

The first duct 140 may be extended toward a rear from one side of the dust collector 130. The first duct 140 may be extended in the shape to wrap around a portion of the connecting pipe 210, which is disposed at a rear of the dust collector 130. The first duct 140 may be provided in a direction perpendicular to the connecting pipe 210.

The first duct 140 may be provided with a hose coupler 141 coupled to the connecting hose 230. The hose coupler 141 may be disposed such that the coupled connecting hose 230 may be parallelly extended with respect to the connecting pipe 210.

The second duct 150 may connect the body 110 and the dust collector 130. The second duct 150 may perform a role as a path to deliver the inlet force generated at the body 110 to the dust collector 130.

The second dust 150 may be installed at a symmetrical position with respect to the first duct 140 while having the connecting pipe 210 as a reference. The second dust 150 may be provided in the shape extended in vertical directions while in parallel with respect to the connecting pipe 210.

The fixing frame 170 may be provided to fix the position of the second cleaning module 200 while in a state that the first cleaning module 100 and the second cleaning module 200 are coupled to each other. The fixing frame 170 may be provided in the shape extended from upper surfaces of the first cleaning module 100 and the second cleaning module 200 toward an upper portion. The fixing frame 170 may be provided to guide the position of the connecting pipe 210 while one side of an upper portion of the fixing frame 170 is bent.

The fixing frame 170 may be provided with a plurality of switches 171 and 173 formed at one side thereof as to drive the vacuum cleaner.

Figure 8:
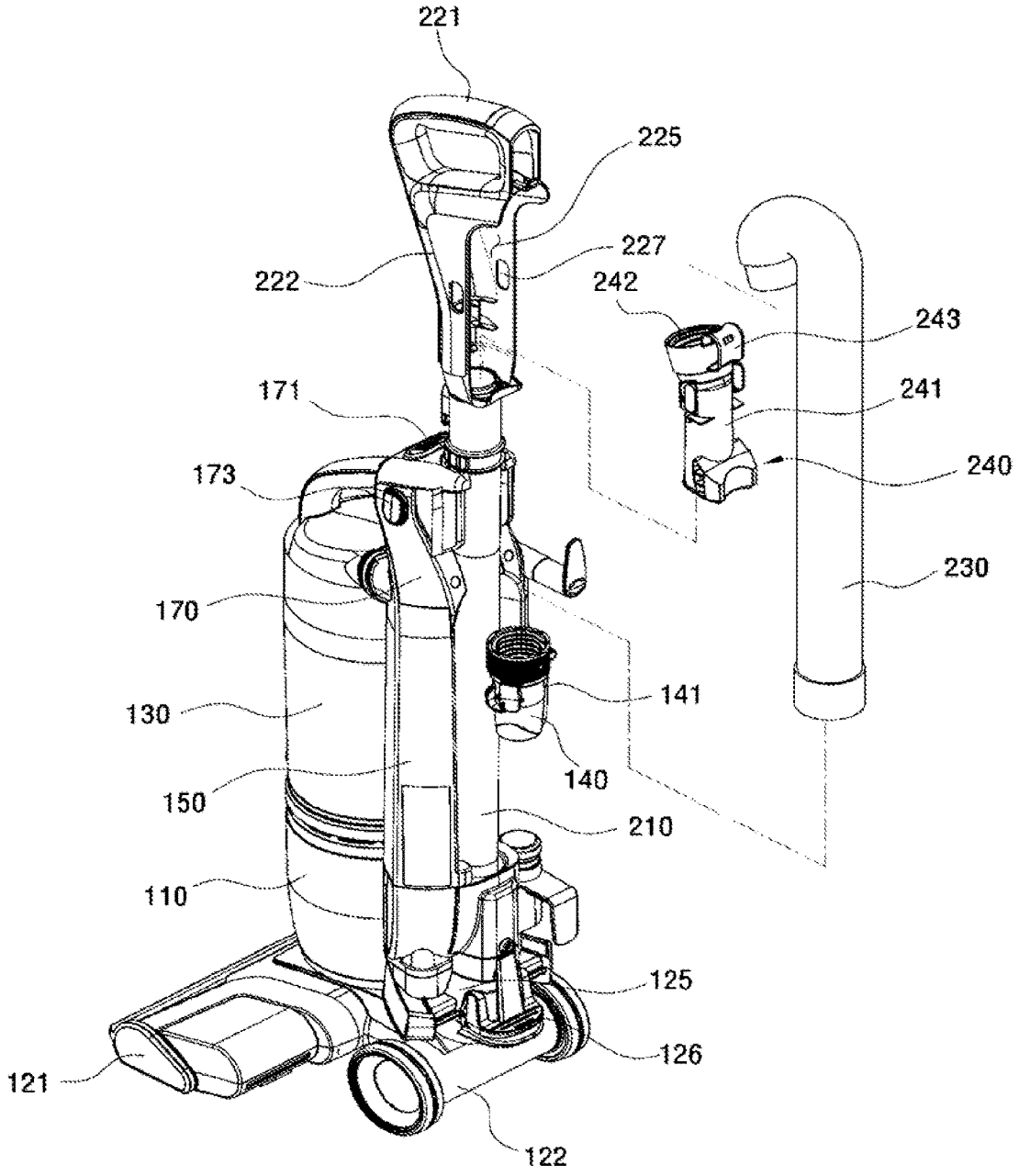
FIG. 8 is an exploded perspective view showing a connector, a handle, and a connecting hose of the vacuum cleaner in accordance with one embodiment of the present disclosure.
Figure 9:
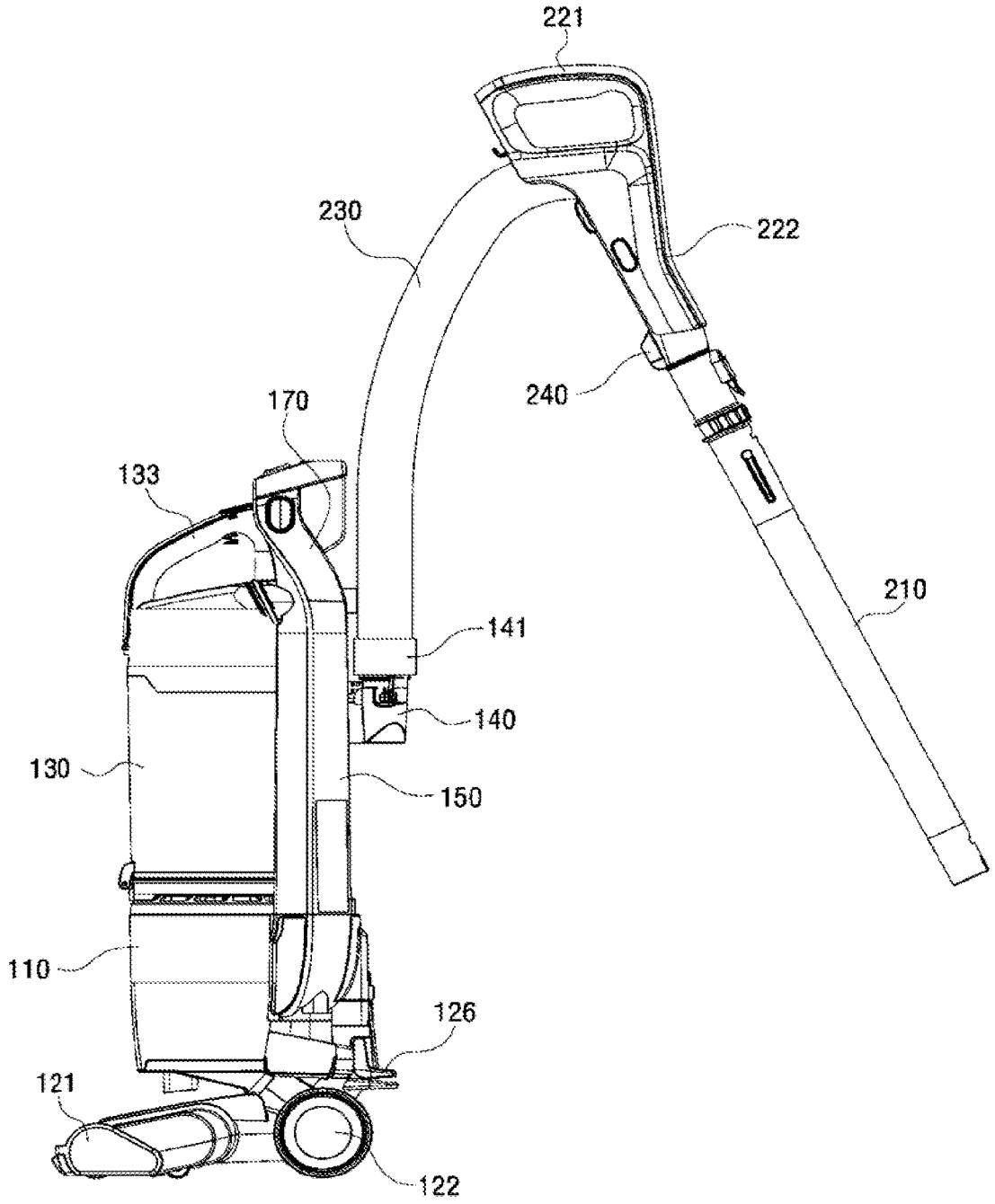
FIG. 9 is a perspective showing a state of a second cleaning module separated from the vacuum cleaner in accordance with one embodiment of the present disclosure.
Figure 10:
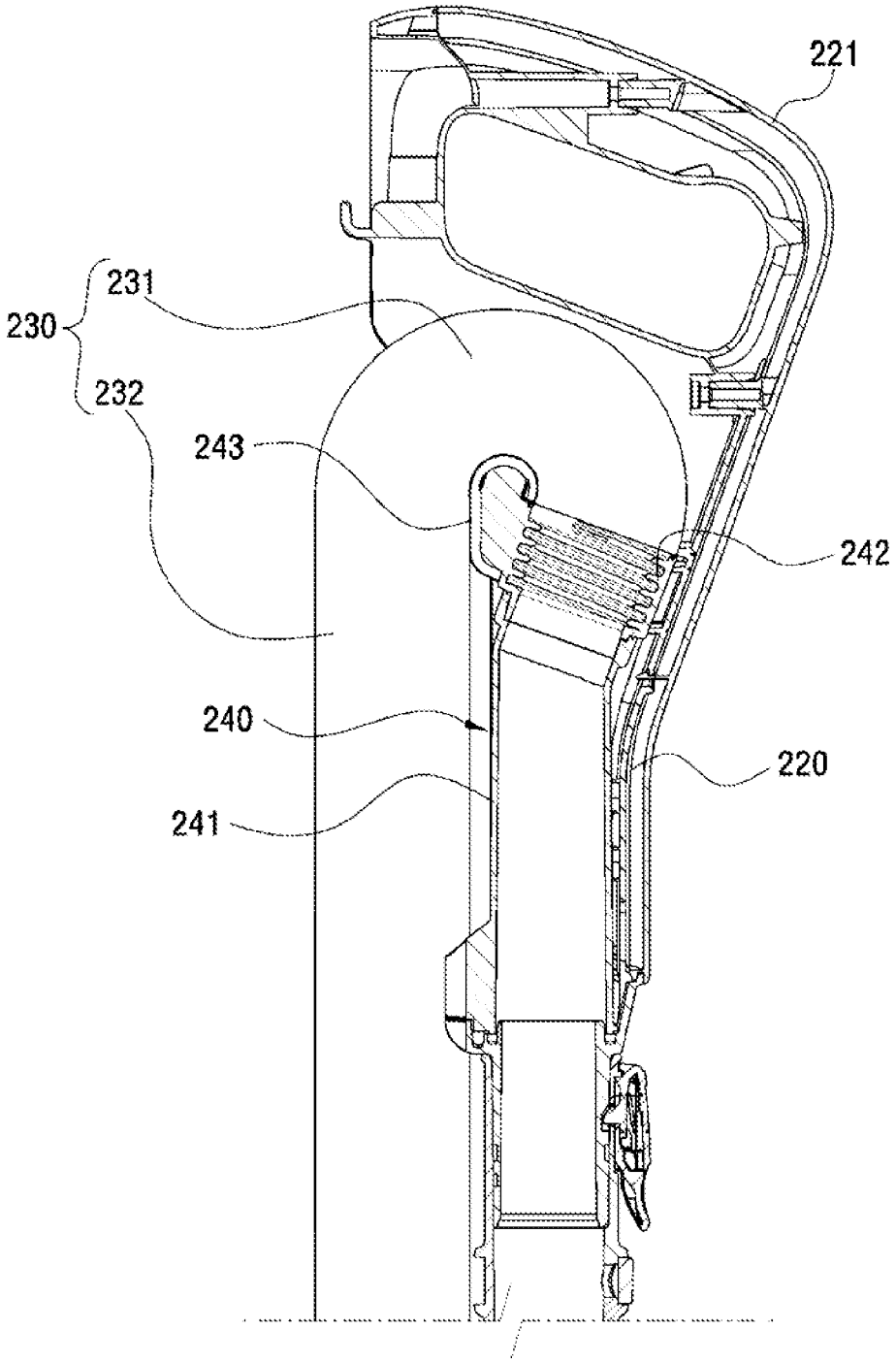
FIG. 10 is a drawing showing a state of the connector and the connecting hose coupled at an inside the handle of the vacuum cleaner in accordance with one embodiment of the present disclosure.
Figure 11:
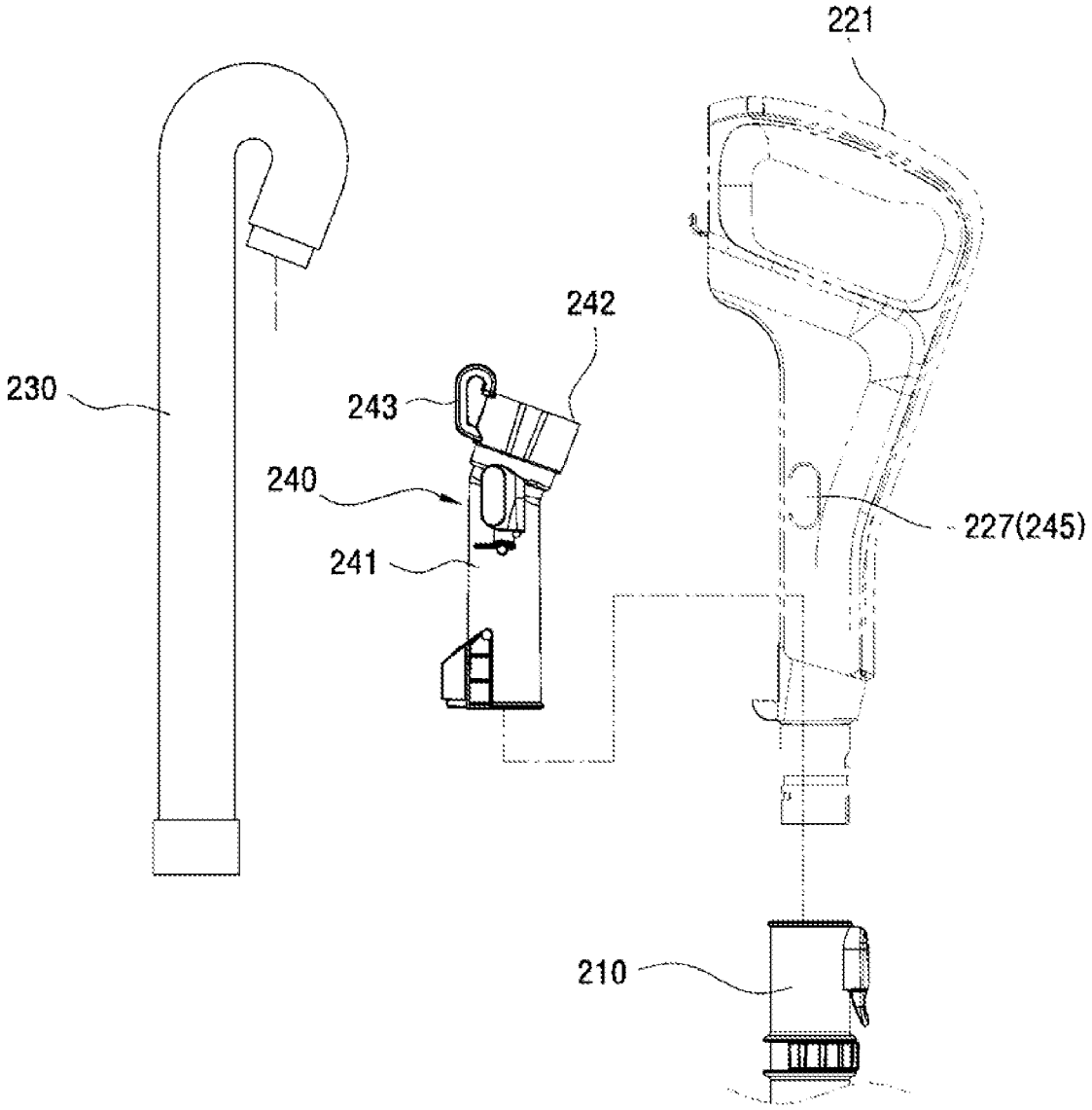
FIG. 11 is a drawing of showing a coupling relation of the connector, the handle, and the connecting hose at the vacuum cleaner in accordance with one embodiment of the present disclosure.

FIG. 8 is an exploded perspective view showing a connector, a handle, and a connecting hose of the vacuum cleaner in accordance with one embodiment of the present disclosure, FIG. 9 is a perspective showing a state of a second cleaning module separated from the vacuum cleaner in accordance with one embodiment of the present disclosure, FIG. 10 is a drawing showing a state of the connector and the connecting hose coupled at an inside the handle of the vacuum cleaner in accordance with one embodiment of the present disclosure, and FIG. 11 is a drawing of showing a coupling relation of the connector, the handle, and the connecting hose at the vacuum cleaner in accordance with one embodiment of the present disclosure.

Referring to FIG. 1 to FIG. 11, the second cleaning module 200 may include the connecting pipe 210, a handle 220, the connecting hose 230, and a connector 240.

The connecting pipe 210 may connect the first cleaning module 100 and the second cleaning module 200. The connecting pipe 210 is provided with one side thereof connected to the pipe connector 125, and is provided with the other side thereof coupled to the handle 220. The connecting pipe 210 may connect the pipe connector 125 and the connector 240 disposed at an inside of the handle 220.

The connecting pipe 210 may perform a role as a path to deliver the air having dust inducted at the first cleaning module 100 to the dust collector 130 through the second cleaning module 200. In addition, the connecting pipe 210 may perform a role as a path to deliver the inlet force generated at the fan motor to the inlet 121.

The connecting pipe 210 may be detachably structured with respect to the first cleaning module 100. The connecting pipe 210 is detachably structured with respect to the pipe connector 125, and may be provided to induct dust separately while detached from the first cleaning module 100. The connecting pipe 210 may perform a role as an inlet hole through which the air having dust is inducted in a case when the second cleaning module 200 is detached.

The handle 220 may be coupled to one side of the connecting pipe 210. The handle 220 may include a handle 221 and a handle body 222.

The handle 221 may be formed at an upper portion of the handle body 222. The handle 221 may be provided at an upper portion of the handle body 222 while having the shape that a user may grasp.

The handle body 222 may be provided at an inner side thereof with an inside space 225, and may be formed in the shape that a rear thereof is open. The inside space 225 may be provided as a space into which a portion of the connecting hole 230 and the connector 240 are inserted.

The handle body 222 may be provided with a coupling hole 225 formed at one side thereof. The coupling hole 227 may be provided at a position corresponding to a coupling detent 245 of the connector 240, which will be described later. The coupling hole 227 may be provided such that the connector 240 may be coupled to or detached from the handle 220 as the coupling detent 245 is detached.

The connecting hose 230 may connect the dust collector 130 and the connecting pipe 210. The connecting hose 230 is provided with one side thereof coupled to the connector 240 as to be connected to the connecting pipe 210 through the connector 240, and is provided with the other side thereof coupled to the first duct 140 as to be connected to the dust collector 130 through the first duct 140.

The connecting hose 230 may be provided such that the length and the shape thereof may be changed. The connecting hose 230 may be provided with a bellows pipe such that the length thereof may be flexible within a certain range.

The connecting hose 230 may perform a role as a path to deliver the air having dust, which is delivered from the connecting pipe 210, to the dust collector 130 through the first dust 140. The connecting hose 230 may perform a role as a path to deliver the inlet force generated at the fan motor to the connecting pipe 210.

The connector 240 may connect the connecting pipe 210 and the connecting hose 230. The connector 240 may include a connector body 241, a first coupler 242, a hose support 243, and the coupling detent 245.

The connector body 241 may be provided in the shape having at an inside thereof a hollow hole. The connector body 241 is provided with one side thereof coupled to the connecting pipe 210, and is provided with the other side thereof coupled to the connecting hose 230. The first coupler 242 may be provided in the shape that is bent toward an inner side of the handle 220 while in the state that the connector 240 is coupled to the handle 220. As the above is provided, the connecting hose 230 coupled to the first coupler 242 may be provided as to be extended to a rear of the handle 220 along an inner side surface of the handle 220.

The hose support 243 may be formed at one side of the connector body 241. The hose support 243 may be installed at a rear of the first coupler 242 in a state that the connector 240 is coupled to the handle 220.

The hose support 243 may be provided with an upper surface thereof formed in a rounded shape. The upper surface of the hose support 243 may be provided as to support a first area 231 of the rounded connecting hose 230 along an inner side surface of the handle 220 while the connector 240 is coupled to the handle 220. As the above is provided, the connecting hose 230 may be extended from the connector 240 along the inner side surface of the handle 220, and may be vertically extended at an outer side of the handle 220 along the hose support 243. The hose support 243 may be provided as to be extended from an outer side of the handle 220 toward a lower direction while in a paralleled state with respect to the connecting pipe 210. As the above-described structure is provided, the connecting hose 230 may be provided with the first area 231 extended in the rounded shape along the inner side surface of the handle 220 in a state that the connector 240 is coupled to the handle 220, and a second area 232 extended from the outer side of the handle 220 toward the lower direction in a paralleled state with respect to the connecting pipe 210. As the above is provided, the flexible connecting hose 230 is closely disposed with respect to the connecting pipe 210, and thus the vacuum cleaner 1 may be provided with a slim external appearance.

The coupling detent 245 may be installed at one side of the connector body 241. The coupling detent 245 may be provided as to be coupled to the coupling hole 227 formed at the handle 220. Thus, the coupling detent 245 may be provided at a position corresponding to the coupling hole 227. The coupling detent 245 may be structured such that the connector 240 may be detached from the handle 220.

As the above-described structure is provided, the vacuum cleaner 1 may be provided with a slim external appearance as the connecting hose 230 is closely disposed with respect to the connecting pipe 210. In addition, in a state that the first cleaning module 100 and the second cleaning module 200 are coupled to each other, the connecting pipe 210 may perform a role as a body of the vacuum cleaner 1, and the member that corresponds to the body in a conventional manner may not needed to be included. As the above, the weight of the vacuum cleaner 1 may be decreased.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A vacuum cleaner, comprising:

a first cleaning module to perform a cleaning of a floor; and a second cleaning module detachably coupled to the first cleaning module and configured to perform a cleaning while detached from the first cleaning module, and the second cleaning module, comprising:

a connecting pipe to deliver inlet force to an inlet of the first cleaning module while connected to the first cleaning module;

a handle connected to one side of the connecting pipe, having an inside space, and provided in a shape in which a rear surface thereof is open;

a connecting hose connecting the connecting pipe to a dust collector; and a connector having a hose support provided to support the connecting hose, and to connect the connecting pipe to the connecting hose, and the hose support is disposed to support the connecting hose curved along an inner side of the handle in a state that the connector is coupled to an inside space of the handle.

2. The vacuum cleaner of claim 1, wherein:

the hose support is provided such that the shape of an upper surface thereof is curved, and the upper surface of the hose support is provided to support a lower surface of the curved connecting hose in a state that the connector is coupled to an inside space of the handle.

3. The vacuum cleaner of claim 1, wherein:

the connector further comprises a connector body, and a first coupler formed at one side of the connector body so that the connecting hose is coupled thereto, and the first coupler is provided while bent toward the inside space of the handle in a state that the connector is coupled to an inside space of the handle.

4. The vacuum cleaner of claim 3, wherein:

the hose support is disposed at a rear of the first coupler in a state that the connector is coupled to the inside space of the handle.

5. The vacuum cleaner of claim 3, wherein:

the hose support is provided with a side surface thereof formed to be parallel with respect to the connector body.

6. The vacuum cleaner of claim 1, wherein:

the connector is provided to be detached from the handle.

7. A vacuum cleaner, comprising:

a first cleaning module to perform a cleaning of a floor; and a second cleaning module detachably coupled to the first cleaning module to perform a cleaning while detached from the first cleaning module, and the second cleaning module, comprising:

a connecting pipe to deliver inlet force to an inlet of the first cleaning module while connected to the first cleaning module;

a handle connected to one side of the connecting pipe, having an inside space, and provided in a shape in which a rear surface thereof is open;

a connecting hose connecting the connecting pipe to a dust collector; and a connector to connect the connecting pipe to the connecting hose, and the connector comprises a hose support provided such that the connecting hose is curved along an inner side of the handle in a state that the connecting hose is coupled to an inside space of the handle, and to guide the connecting hose to be extended toward a lower direction in a parallel state with respect to the connecting pipe.

8. The vacuum cleaner of claim 7, wherein:

the hose support is provided such that the shape of an upper surface thereof is curved, and the upper surface of the hose support is provided to support a lower surface of the curved connecting hose in a state that the connector is coupled to the inside space of the handle.

9. The vacuum cleaner of claim 7, wherein:

the connector further comprises a connector body, and a first coupler formed at one side of the connector body so that the connecting hose is coupled thereto, and the first coupler is provided while bent toward an inner side of the handle in a state that the connector is coupled to the inside space of the handle.

10. The vacuum cleaner of claim 9, wherein:

the hose support is disposed at a rear of the first coupler in a state that the connector is coupled to an inside space of the handle.

* * * * *